United States Patent [19]

Nishimura

[11] Patent Number: 4,881,720

[45] Date of Patent: Nov. 21, 1989

[54] HAND OPERATED CHAIN BLOCK

[75] Inventor: Yosaku Nishimura, Osaka, Japan

[73] Assignees: Vital Kogyo Kabushiki Kaisha, Osaka, Japan; Ingersoll-Rand Company, Phillipsburg, N.J.

[21] Appl. No.: 236,031

[22] Filed: Aug. 24, 1988

[30] Foreign Application Priority Data

Feb. 29, 1988 [JP] Japan ..... 63-26556[U]

[51] Int. Cl.[4] ..... B66D 3/16

[52] U.S. Cl. ..... 254/358; 254/411

[58] Field of Search ..... 254/358, 372, 383, 390, 254/403, 405, 411; 226/196, 199

[56] References Cited

U.S. PATENT DOCUMENTS

| | | | |
|---|---|---|---|
| 126,391 | 5/1872 | Hall et al. | 254/403 |
| 349,520 | 9/1886 | Samuel | 254/411 X |
| 385,856 | 7/1888 | Hambay | 254/358 X |
| 428,675 | 5/1890 | Holt | 254/358 X |
| 577,330 | 2/1897 | Speidel | 254/358 |
| 2,637,525 | 5/1953 | Lock | 254/372 X |
| 3,030,076 | 4/1962 | Stevens | 254/358 |
| 3,894,720 | 7/1975 | Koji | 254/358 X |
| 4,221,364 | 9/1980 | Nishimura | 254/358 X |

FOREIGN PATENT DOCUMENTS

| | | | |
|---|---|---|---|
| 19725 | 6/1973 | Japan . | |
| 36204 | 10/1974 | Japan . | |
| 8205 | of 1893 | United Kingdom | 254/358 |

*Primary Examiner*—Joseph J. Hail, III

*Attorney, Agent, or Firm*—Christensen, O'Connor, Johnson & Kindness

[57] ABSTRACT

A hand-operated chain block having a hand chain wheel portion light in weight and simplified in construction and which permits safe and smooth hand chain operation. A hand chain wheel cover having a leftwardly laid-down U-shaped configuration which covers the upper, lower, and front portions of the hand chain wheel is mounted on a plurality of stays disposed on side plates of a chain block body, and hand chain guide plates are mounted on the upper right and left ones of the stays so as to cover substantially entire periphery of the hand chain wheel. Each of the hand chain guide plates is formed of one metal plate in a folded pattern. A pivotal support portion formed in a crooked pattern on the top end portion of each hand chain guide plate is inserted through one of the upper stays. Thus, each hand chain guide plate is pivotally suspendingly supported, while a hand chain wound around the hand chain wheel is inserted through a hand chain guide portion formed at the lower end portion of the hand chain guide plate for being thereby guided.

3 Claims, 3 Drawing Sheets

HAND OPERATED CHAIN BLOCK

BACKGROUND OF THE INVENTION

1. Field of the Invention

This invention relates to hand operated chain blocks and, more particularly, to a hand operated chain block which is light-weight and simple in construction with respect to its hand chain wheel portion and which permits safe and smooth hand chain operation.

2. Description of the Prior Art

Hitherto, various different types of hand chain wheel construction for hand operated chain blocks have been developed which are provided with measures for safe hand chain operation and which is reduced in weight and simplified for the purpose of reduction in weight of the entire chain block.

In such situation, the present inventor has already proposed two types of chain block construction, namely, one disclosed in Japanese Utility Model Publication No. 19725/1973, and the other disclosed in Japanese Utility Model Publication No. 36204/1974.

The chain block disclosed in Japanese Utility Model Publication No. 19725/1973 comprises a positioning dowel formed on a hand chain guide plate, and a small slit formed in a hand chain wheel cover, the hand chain guide plate being adapted to be fixedly mounted to the chain block by a stay for hand chain wheel cover mounting and through engagement of the dowel with the small slit. The hand chain guide plate has a guide portion formed in such an overhanging pattern that it covers an upper edge portion of a side window of the hand wheel chain cover.

The other chain block disclosed in Japanese Utility Model Publication No. 36204/1974 has a hand chain cover of such split-type construction that it consists of an upper cover having a key-shaped section which covers a front upper peripheral portion of a hand chain wheel and a U-shaped lower cover which covers a front peripheral portion of the hand chain wheel other than covered by the upper cover. The lower cover is formed of a plate material having greater thickness than the upper cover and has at its opposite side ends a hand-chain guide plate integrally formed therewith. Opposite side ends of a front plate portion of the upper cover are placed in superposed relation with the corresponding ends of an upper portion of the lower cover, the superposed portions being secured by a common bolt to side plates of a chain block body, a median portion of the lower cover being secured by another bolt to the side plates.

However, these types of chain block construction are not fully satisfactory because of a number of deficiencies found therewith which are pointed out below; hence, further improvement has been demanded.

In the first mentioned disclosure, i.e., Japanese Utility Model Publication No. 19725/1973, the mounting arrangement for the hand chain guide plate is comparatively simple in itself, but the work required for engagement of the positioning dowel with the small slit in connection with the mounting of the guide plate is troublesome, which fact is disadvantageous from the standpoint of assembly work efficiency.

Another difficulty is that since the guide portion of the hand chain guide plate is located in an upper edge portion of the hand chain wheel cover, the entire side portions of the hand chain wheel are open and accordingly the hand chain is outwardly exposed, which fact is disadvantageous from the stand point of safety because the operator may possibly touch the hand chain wheel portion by hand at the open side portion, or because some falling object may possibly become engaged by the wheel portion.

In the second mentioned disclosure, i.e., Japanese Utility Model Publication No. 36204/1974, the guide plates for guiding the hand chain are small-sized plates provided at opposite ends of the lower cover and therefore the side portions of the hand chain wheel are substantially entirely open, which fact is disadvantageous from the standpoint of safety as is the case with the first mentioned disclosure.

Another drawback is that the lower cover for the hand chain wheel is comparatively thick walled, so that further reduction in weight is required of it, while on the other hand reduction in thickness for such purpose may possibly result in decreased strength of the lower cover.

Furthermore, both of the foregoing chain blocks have a deficiency in that in the case where the hand chain is pulled at comparatively high speed, if such operation is made in such condition that, for example, no load is being hung by a load chain, possible twists (snarls) cannot completely be straightened out by the hand chain guide plate. This means that the hand chain is wound in twisted condition around the hand chain wheel, smooth hand chain operation being thus prevented.

BRIEF SUMMARY OF THE INVENTION

This invention is intended to overcome aforesaid difficulties with the prior art chain blocks, and accordingly it is a primary object of the invention to provide a novel hand-operated chain block which eliminates the difficulties.

It is another object of the invention to provide a hand-operated chain block which is safety-oriented, light in weight, and simple in construction with respect to it hand chain portion, and which assures smooth hand chain operation.

It is a further object of the invention to provide a hand-operated chain block which can utilize an existing cover mounting stay as such for hand chain wheel mounting, and which can serve for purposes of simplification of and weight reduction in chain block construction and facilitate ease of assembly, thereby contributing toward improved productivity, and manufacturing cost and production cost reduction.

It is another object of the invention to provide a hand-operated chain block which has a hand chain guide plate formed by bending of one metal plate, with a pivotal support portion crookedly formed at an upper portion thereof and a hand chain guide portion formed at a lower portion thereof, and which is therefore very light in weight, simple in construction without its total weight being increased and yet is of sufficient strength.

It is a still further object of the invention to provide a hand-operated chain block which is free of any possibility of hand chain disengagement or snarling and of any danger of the operator touching the hand chain wheel portion by hand or of any dropping object being engaged by such wheel portion, and which assures a very high degree of safety.

It is another object of the invention to provide a hand operated chain block which has a hand chain guide plate suspendingly pivotally supported by an upper stay so that where a hand chain is operated obliquely relative to a hand chain wheel, the hand chain guide plate can effectively function as a guide member for the hand chain.

It is another object of the invention to provide a hand operated chain block which has a lower horizontal portion by which a hand chain is prevented from going in contact with a hand chain wheel cover when the hand chain is obliquely operated, generation of any undesirable contact noise being thereby avoided.

The hand-operated chain block in accordance with the present invention comprises a hand chain wheel having its substantially entire periphery covered by a hand chain wheel cover and a pair of hand chain guide plates, right and left, said hand chain wheel cover having a sectional configuration of a leftwardly laid-down U shape and being so mounted on a plurality of stays disposed on side plates of a chain block body as to cover upper, lower, and front portions of the hand chain wheel, said pair of hand chain guide plates being so mounted on upper right and upper left ones of said plurality of stays as to cover side portions of said hand chain wheel, each of said hand chain guide plates being formed of one metal plate in a folded pattern, with a pivotal support portion formed at an upper end portion thereof in a crooked pattern and with a hand chain guide portion formed at a lower end portion thereof, said pivotal support portion extending through one of said upper stays, said hand chain guide plate being suspendingly pivotally supported by said stays, a hand chain wound around said hand chain wheel being inserted through said hand chain guide portion for being thereby guided.

The above and other related objects and features of the invention will be apparent from a reading of the following description of the disclosure found in the accompanying drawings and the novelty thereof pointed out in the appended claims.

DETAILED DESCRIPTION OF THE PREFERRED EMBODIMENT

Figure 1:
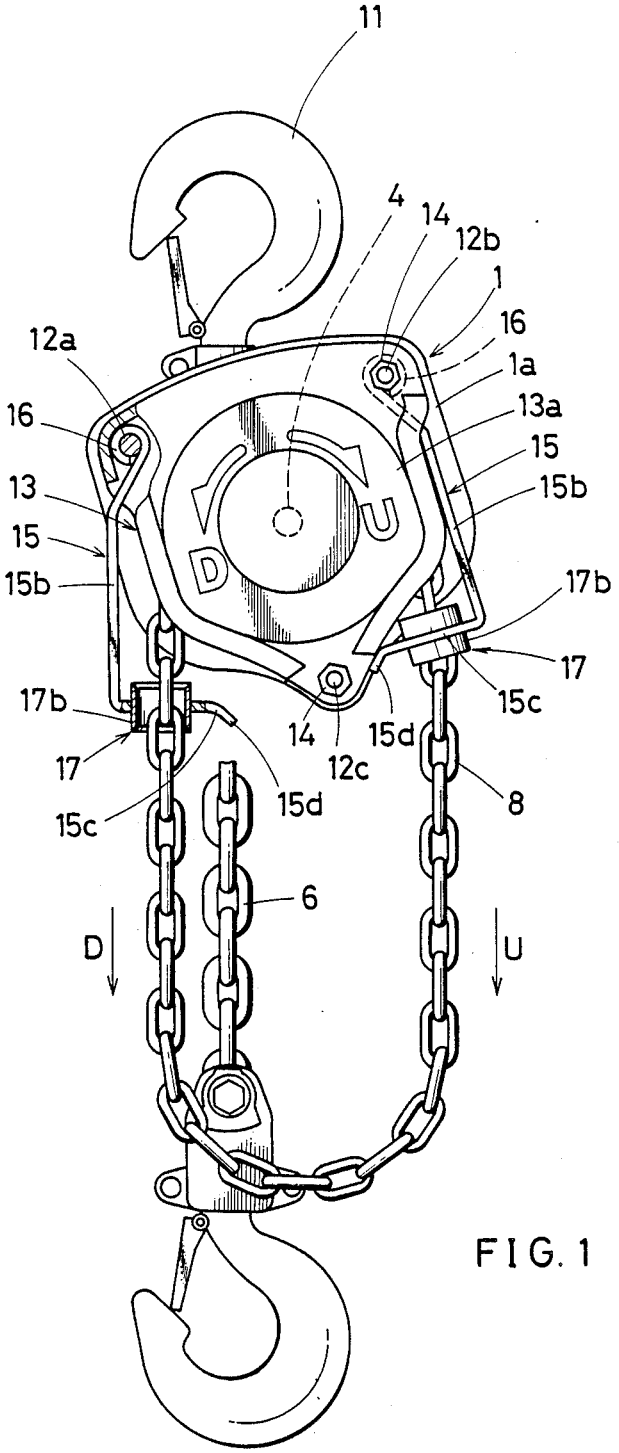
FIG. 1 is a front view, partially cut open, showing a hand-operated chain block which represents one embodiment of the invention.
Figure 2:
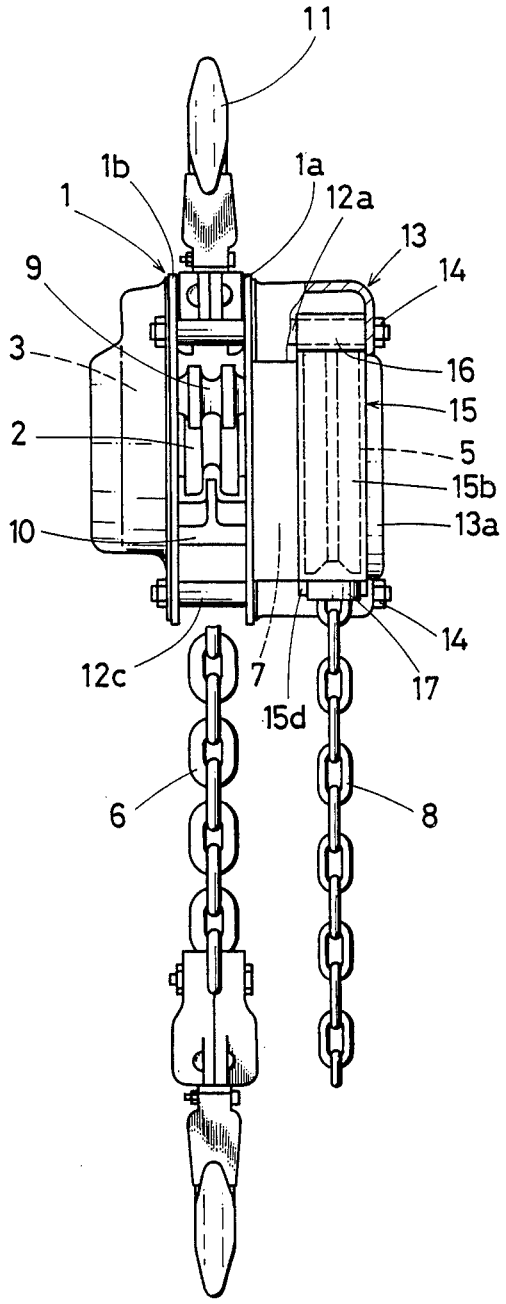
FIG. 2 is a side view, partly cut open, of the chain block.
Figure 3:
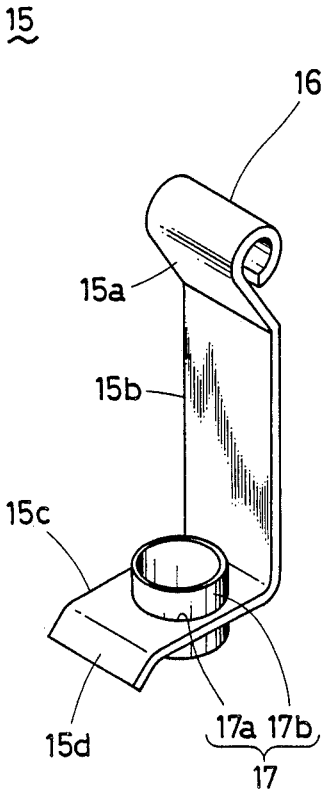
FIG. 3 is a perspective view showing a hand chain guide plate of the chain block.

A hand-operated chain block embodying the invention is shown in FIGS. 1 and 2. The chain block comprises a chain block body 1, a load sheave 2, a reduction gear mechanism 3, a drive shaft 4, a hand chain wheel 5, and the like, the load sheave 2 being rotatably supported between front and rear side plates 1*a*, 2*b* which constitutes the chain block body 1, a load chain 6 being wound around the load sheave 2. The load sheave 2 is connected through the reduction gear mechanism 3 to the drive shaft 4, which is in turn connected through a friction plate mechanism 7 to the hand chain wheel 5 on which a hand chain 8 is wound.

The drive shaft 4 is rotatably supported in the load sheave 2. Construction of these main portions is well known in the art, and therefore description of them is omitted. Numeral 9 is a guide for guiding the load chain 6; numeral 10 is a stripper for preventing the load chain from snarling; and 11 is a hook for suspending the chain block body 1.

The hand chain wheel 5 is of such construction that substantially entire periphery of the chain wheel 5 is covered by a hand chain wheel cover 13 and hand chain guide plates 15, 15.

The hand chain wheel cover 3, as FIG. 2 shows, has a sectional configuration of a leftwardly laid down U shape. It is mounted, by being fastened with nuts 14 . . . , to three stays 12*a*, 12*b*, 12*c* disposed on the front and rear side plates 1*a*, 1*b* of the chain block body 1, whereby the upper and lower, and front portions of the hand chain wheel 5 is covered by the hand chain wheel cover 3.

The hand chain guide plates 15, 15 are suspendingly and pivotally mounted to upper right and left ones 12*a*, 12*b* of the stays so that they cover side openings of the hand chain cover 13, that is, right and left side portions of the hand chain wheel 5.

The hand chain guide plates 15 each is formed of one metal plate folded in generally L shape.

An upper portion a of the hand chain guide plate 15 is folded inwardly with some degree of inclination, the top end thereof being outwardly bent to give an arcuate section, thus forming a pivotal support portion 16. This pivotal support portion 16 is inserted through the upper stay 12*a* or 12*b*, whereby the hand chain guide plate 15 is suspendingly and pivotally supported at the rear side of the front plate portion 13*a* of the hand chain wheel cover 13.

A central portion 15*b* of the hand chain guide plate 15, as mounted to the stays 12*a*, 12*b*, covers the outer side of the hand chain 8 and serves to smoothly guide the hand chain 8 in conjunction with a hand chain guide portion 17 which will be described hereinafter.

A lower portion 15*c* of the hand chain guide plate 15 is inwardly horizontally folded and has said hand chain guide portion 17 formed therein. The hand chain guide portion 17 comprises a mounting hole 17*a* bored through the lower horizontal portion 15*c* and a cylindrical tube 17*b* fixedly perpendicularly disposed therein by welding or otherwise, the inner diameter of the cylindrical tube 17*b* being of such size as to permit the hand chain to pass therethrough. The hand chain guide portion 17 is adapted to allow passage of the hand chain 8 wound on the hand chain wheel 8 for being guided therethrough.

In addition to its function to guide the hand chain 8, the hand chain guide portion 17 serves to prevent the hand chain 8 from getting twisted (snarling) as the latter passes through the guide portion 17. This snarl preventing action of the hand chain guide portion 17 is especially effective in the case where the hand chain 8 is pulled at comparatively high speed as, for example, in hand chain operation in such condition that no load is hung from the load chain 6.

The front end 15*d* of the lower horizontal portion 15*c* is bent slightly downward to give an abutment portion for abutment with the hand chain wheel cover 13. By this arrangement the hand chain 8 is prevented from going into contact with the hand chain wheel cover 13 when the chain block body 1 is tilted by pull of the hand chain 8, as FIG. 1 shows (see the righthand side portion of the figure).

With the chain block arranged as above described, when the hand chain 8 is pulled in a load hoisting direction U, the force of the pull is transmitted to the load sheave 2 through the hand chain wheel 5, the friction plate mechanism 7, the drive shaft 4, and the reduction gear mechanism 3, so that the load sheave 2 is rotated in the hoisting direction, the load chain 6 wound thereabout being thus hoisted.

Whilst, by pulling the hand chain 8 in a lowering direction D, the load chain 6 is lowered in a reverse manner.

In this case, the hand chain 8 is guided by the hand chain guide plates 15, 15 so that smooth pull movement is assured, the hand chain 8 being thus effectively prevented from snarling. The guiding function of the hand chain guide plates 15, 15 is effectively performed especially in case of hand chain operation in such condition that no load is being hung from the load chain 6.

Pull operation of the hand chain 8 in case of no load being hung from the load chain 6 is carried out at comparatively high speed, and accordingly the upper portion of the hand chain 8 is inclined to stretch outward (right and left directions in FIG. 1) under inertia force; however, the hand chain 8 strikes on the central portions **15*b*, 15*b*, being thereby prevented from stretching outward so that winding of the hand chain 8 around the hand chain wheel 5** can be smoothly performed.

At that portion of the hand chain wheel 5 on which the hand chain 8 is wound there is provided a guide portion (not shown) for mending any snarl of the hand chain 8, but when pull operation of the hand chain 8 is carried out at such high speed as above mentioned, often such mending cannot fully be effected by the guide portion only. Such event can be completely prevented by the hand chain guide portion 17.

As the hand chain 8 passes through the cylindrical tube **17*b* of the hand chain guide portion 17, any snarl caused to the hand chain 8 is quickly and smoothly eliminated by the action of the inner diametral surface of the cylindrical tube 17*b***, so that smooth hand chain operation is assured.

The upper portion of the hand chain 8, or that portion thereof which is wound on the hand chain wheel 5, is not exposed outside because it is covered with the hand chain guide plates 15, 15; therefore, any danger of the operator touching the hand chain wheel by hand at such position or of any falling object being engaged by the wheel an be effectively prevented, complete safety being thus assured.

Furthermore, the hand chain guide plates 15, 15 are pivotally movable about the upper right and left stays **12*a*, 12*b* respectively; therefore, even when the hand chain 8 is obliquely handled relative to the hand chain wheel 5, no unreasonable force is exerted on the hand chain guide plates 15, 15, so that hand chain guiding action of the plates 15, 15** can be effectively performed at all times.

In addition, since the lower horizontal portion **15*c* is inwardly bent so that it is kept away from the hand chain wheel cover 13 at a certain distance; hence, even when the hand chain 8 is obliquely handled as above mentioned, the hand chain 8 is prevented from going in contact with the hand chain wheel cover 13**, generation of any undesirable contact noise being thus avoided.

As above described, the present invention provides various outstanding advantages as enumerated below, and thus a hand operated chain block having excellent practical performance quality can be obtained.

(1) The hand chain guide plates each has at its upper end portion a pivotal support inserted through a stay provided on a side plate of the chain block body, being thus pivotally suspendingly supported; therefore, any existing stay for cover mounting can be used as such concurrently for hand chain wheel mounting. This permits simplification in construction and weight reduction of chain blocks.

Moreover, the hand chain guide plates can be readily mounted to the chain block body by inserting each of them at it pivotally supported portion through the stay, which means much simplified chain block assembly work, hence increased productivity, and reduced production and product costs.

(2) The hand chain guide plates each is formed of one metal plate by beding same in the specified pattern, with a pivotally supported portion formed in a crooked pattern at its top end portion and with a hand chain guide portion at its lower end portion. Therefore, they are very light in weight and simple in construction. This fact contributes much toward total weight reduction rather than weight increase, and still provides sufficient strength.

(3) The hand chain wheel is covered at its upper, lower, and front portions with a cover having a sectional configuration of a leftwardly laid down U shape, being covered at its right and left side portions with a hand chain guide plate. The hand chain wound around the hand chain wheel is passed through the hand chain guide portions of the hand chain guide plates. Therefore, the hand chain is free from the possibility of being disengaged or snarled, and the hand chain wheel is free from the danger of human hand touching or any falling object being engaged thereby, a high degree of safety being the assured.

(4) The hand chain guide plates are suspendingly pivotally supported on the upper stays. Therefore, when the hand chain is operated in oblique relation to the hand chain wheel, the guide plates can effectively function as guide members for the hand chain despite the fact that they are of very simple construction.

(5) The hand chain guide plates each has a lower horizontal portion of a generally L-shaped configuration which is inwardly oriented. Therefore, when the hand chain is obliquely handled, by means of the lower horizontal portion the hand chain is prevented from going into contact with the hand chain wheel cover, generation of any undesirable contact noise being thus avoided.

It is understood that the embodiment illustrated in the detailed description of the invention is intended to clarify the subject matter of the invention by way of example; therefore, the invention is not limited by the embodiment and should not be interpreted in a narrow sense, but rather it should be interpreted in a broader sense in that various modifications may be made within the spirit and scope of the invention as hereinafter claimed.

What is claimed is:

1. In a hand-operated chain block comprising a load sheave rotatably supported by and between a pair of side plates and a hand chain wheel mechanically coupled to said load sheave and positioned on the side of one of said side plates facing away from said load sheave, the improvement comprising an enclosure for covering substantially the entire periphery of said hand chain wheel, said enclosure including:

a plurality of stays mounted on said side of said one of said side plates about said hand chain wheel, two of said stays lying above the axis of rotation of said hand chain wheel when said hand-operated chain block is suspended from above;

a hand chain wheel cover having a leftwardly laid-down U-shaped sectional configuration, said hand chain wheel cover mounted on said plurality of stays so as to cover upper, lower, and front portions of said hand chain wheel, a pair of hand chain guide plates, each said hand chain guide plates mounted on one of said two of said plurality of stays as to cover side portions of said hand chain wheel, each of said hand chain guide plates being formed of one metal plate in a folded pattern, with a pivotal support portion formed at an upper end portion thereof in a crooked pattern and with a cylindrical hand chain guide portion formed at a lower end portion thereof, said two stays extending through said pivotal support portions, said hand chain guide plates being suspendingly pivotally supported by said stays, and a hand chain wound around said hand chain wheel, said hand chain being inserted through said hand chain guide portions for being guided by said hand chain guide portions.

2. A hand-operated chain block as set forth in claim 1 wherein each of said hand chain guide plates is formed of one metal plate bent in a substantially L-shaped configuration, said hand chain guide plate is bent at it upper end portion in an arcuate sectional configuration to form said pivotal support portion, a through hole having a diameter size large enough to allow said hand chain to pass therethrough is bored through a lower horizontal portion directed inwardly of said hand chain guide plate, said cylindrical hand chain guide portion being thereby formed.

3. A hand-operated chain block as set forth in claim 1 wherein the lower horizontal portion of each of said hand chain guide plates has a mounting hole bored therethrough, a cylindrical member having an inner diametral size enough to allow said hand chain to pass through is fixedly mounted in said mounting hole, said cylindrical hand chain guide portion being thereby formed.

* * * * *